US006363341B1

(12) United States Patent
Tolhuizen et al.

(10) Patent No.: US 6,363,341 B1
(45) Date of Patent: Mar. 26, 2002

(54) ENCODER FOR MINIMIZING RESULTING EFFECT OF TRANSMISSION ERRORS

(75) Inventors: Ludovicus M. G. M. Tolhuizen; Robert J. Sluijter; Andreas J. Gerrits, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/310,087

(22) Filed: May 11, 1999

(30) Foreign Application Priority Data

May 14, 1998 (EP) ..... 98201590

(51) Int. Cl.[7] ..... G10L 19/00
(52) U.S. Cl. ..... 704/219; 704/220; 704/201
(58) Field of Search ..... 704/201, 219, 704/211, 220, 221, 222; 341/51

(56) References Cited

U.S. PATENT DOCUMENTS 5,012,518 A * 4/1991 Liu et al. ..... 381/42
5,528,723 A * 6/1996 Gerson et al. ..... 704/211
5,682,407 A * 10/1997 Funaki ..... 375/240
5,920,832 A * 7/1999 Wuppermann et al. ..... 704/219
5,926,785 A * 7/1999 Akamine et al. ..... 704/219
6,014,619 A * 1/2000 Wuppermann et al. ..... 704/219
6,038,530 A * 3/2000 Taori et al. ..... 704/219
6,157,907 A * 12/2000 Taori et al. ..... 704/221
6,182,030 B1 * 1/2001 Hagen et al. ..... 704/201
6,272,196 B1 * 8/2001 Wuppermann et al. ..... 375/377

OTHER PUBLICATIONS

By J. De Marca and N. Jayant "An Algorithm for Assigning Binary Indices to the Core Vectors of a Multi–Dimensional Quantizer", Published in the Proceedings of the IEEE International Conference on Communications, 1987 (ICC–87), vol. 2, pp. 1128–1132.

* cited by examiner

*Primary Examiner*—Richemond Dorvil
*Assistant Examiner*—Susan McFadden
(74) *Attorney, Agent, or Firm*—Jack D. Slobod

(57) ABSTRACT

A transmission system comprising a transmitter with a signal encoder, the signal encoder having an input for a signal to be encoded and a codebook entry selector for selecting a codebook entry for obtaining a synthetic signal giving a best approximation of a signal representative of the input signal, wherein the codebook entry includes a plurality of samples that can assume more than two values and is identified with a sequence of symbols, a receiver having a decoder with a codebook for deriving the codebook entry from the sequence of symbols received from the transmitter, wherein the codebook entries corresponding to sequences of symbols that differ in one particular symbol value also differ in one single sample value.

7 Claims, 3 Drawing Sheets

ENCODER FOR MINIMIZING RESULTING EFFECT OF TRANSMISSION ERRORS

The present invention is related to a transmission system comprising a transmitter with a signal encoder having an input for a signal to be encoded, said signal encoder comprises a codebook entry selector for selecting a codebook entry for obtaining a synthetic signal giving a best approximation of a signal representative of the input signal, the codebook entry comprises a plurality of samples that can assume more than two values, said codebook entry being identified with a sequence of symbols, the transmitter being arranged for transmitting the sequence of symbols to a receiver, the receiver comprises a decoder with a codebook for deriving the codebook entry from the received sequence of symbols.

A prior art transmission system is known from the conference paper "An algorithm for assigning binary indices to the code vectors of a multi-dimensional quantizer" by J. De Marca and N. Jayant published in the proceedings of the IEEE International Conference on Communications '87 (ICC-87), Volume 2, pp. 1128–1132.

Such transmission systems are e.g. used in applications in which speech or video signals have to be transmitted over a transmission medium with a limited transmission capacity or have to be stored on storage media with a limited storage capacity. Examples of such applications are the transmission of speech signals over the Internet, the transmission of speech signals from a mobile phone to a base station and vice versa and storage of speech signals on a CD-ROM, in a solid state memory or on a hard disk drive.

In a transmission system according to the preamble, the signal to be encoded is compared with a plurality of synthetic signal segments. Each of the synthetic signal segments is derived from one of the codebook entries. The synthetic signal segments can e.g. be obtained by filtering the sequence of samples contained in the codebook entry by means of a synthesis filter. The codebook entry corresponding to the synthetic signal segment which best matches the input signal is encoded and transmitted to the receiver.

An alternative possibility is to derive a residual signal from the input signal by means of an analysis filter and to compare the residual signal with each of the codebook entries. The codebook entry best matching the residual signal is encoded and transmitted to the receiver.

It is also conceivable that the input signal is directly compared with the codebook entries and that the best matching codebook entry is encoded and transmitted.

In the receiver, the received code associated with the codebook entry is decoded and a replica of the input signal is reconstructed. This can be done by applying the plurality of samples to a synthesis filter which has a similar transfer function as the synthesis filter used in the encoder. If an analysis filter is used in the encoder, a synthesis filter is used which has a transfer function which is the inverse of the transfer function of the analysis filter.

If no analysis or synthesis filter is used in the encoder, the reconstructed signal is directly derived from the decoded codebook entry.

It can happen that due to transmission impairments, the encoded codebook entry is received in error. Consequently, in the receiver a codebook entry different from the codebook entry selected in the encoder will be used for reconstructing the input signal. Using the wrong codebook entry for reconstructing the input signal will in general result in an audible/visible error in the reconstructed signal.

In the transmission system according to the above mentioned conference paper it is tried to minimize the effect of transmission errors by assigning to similar codebook entries similar sequences of symbols in such a way that if a transmission error occurs in one of the symbols, the codebook entry corresponding to said erroneously received sequence of symbols differs only slightly from the codebook entry corresponding to the originally transmitted sequence of symbols. In this way it is obtained that the perceptual effect of a transmission error is substantially reduced.

The object of the present invention it to provide a transmission system in which the perceptual effect of transmission errors is even more reduced than in the prior art system.

To achieve said object the present invention is characterized in that the codebook entries corresponding to sequences of symbols differing in one particular symbol value, differ in one single sample value. This particular symbol value can be the least significant symbol, but it is also possible that it is a symbol at a different position in the sequence of symbols.

For the purpose of designing the assignment of sequences of symbols to codebook entries in the prior art system, it is assumed that every symbol in the sequence of symbols can be in error. This assumption results in a non-optimum assignment of codebook entries to sequences of symbols when it is taken into account that the possibility of a transmission error often differs for several symbols. It is possible that an error correcting code is used for a part of the sequence of symbols. It is also possible that hierarchical modulation is used resulting in different error probabilities. By restricting the number of symbols which can be in error, it becomes possible to reduce the difference between the codebook entries.

By making codebook entries differing in one single sample to correspond to sequences of symbols differing in one particular symbol value (mostly the most vulnerable one) a near optimum codebook is obtained.

An embodiment of the present invention is characterized in that the difference between said sample values of codebook entries corresponding to sequences of symbols differing in one particular symbol value, is equal to a smallest quantization step of said sample value.

By choosing the difference between the sample values corresponding to "neighboring" sequences of symbols equal to the smallest quantization step, an optimum codebook with respect to the perceptual effect of a single transmission error is obtained.

A further embodiment of the invention is characterized in that the number of possible sample values is odd. It is found that in the case of an odd number of possible values it becomes possible to calculate the mapping between sequences of symbols and the corresponding plurality of samples and its inverse with the same algorithm. This results in a reduced amount of resources required to implement a combination of encoder and decoder, because the resources for performing the codebook related calculation can be shared.

If the combination of encoder and decoder is realized by a program running on a programmable processor, the amount of memory to hold the program is reduced. If the combination of encoder and decoder is realized in hardware, the amount of chip area will be reduced because the part for determining the sequence of symbols from the plurality of samples can also be used for determining the plurality of samples from the sequence of symbols.

A still further embodiment of the present invention is characterized in that a numerical value associated with a first codebook entry is equal to the numerical value of the sequence of symbols of a second codebook entry, and in that the numerical value associated with the second codebook entry is equal to the numerical value of the sequence of symbols associated with the first codebook entry.

According to this aspect of the invention, it becomes possible to determine the index of a given codebook entry by first using said given codebook entry as index to determine a second codebook entry and secondly by using the second codebook entry as index to determine a codebook entry which represents the index of the given codebook entry.

The invention will now be explained with reference to the drawings.

Figure 1:
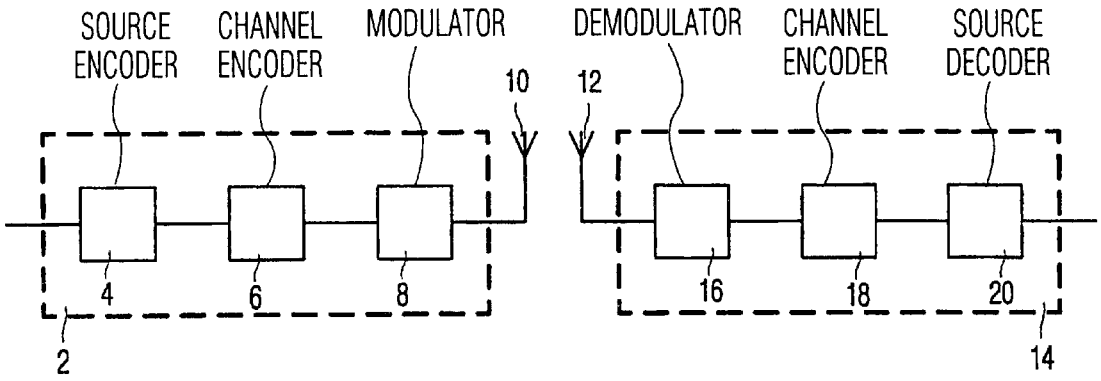
FIG. 1 shows a transmission system in which the present invention can be used.

In the transmission system according to FIG. 1 the signal to be transmitted is applied to a source encoder 4 in a transmitter 2. This source encoder 4 encodes the input signals using the present invention as will be explained later. The encoded signal available at the output of the source encoder 4 is applied to an input of a channel encoder 6. The channel encoder 6 encodes a part of the output signal of the source encoder.

For use of the present invention it is possible that all bits but one of the sequence of symbols indicating the codebook entry are encoded by the channel encoder 6. For mobile radio transmission systems often convectional codes are used in the channel encoder 6.

The output of the channel encoder 6 is connected to the input of a modulator 8 which modulates the output signal of the channel encoder 6 onto a carrier. Subsequently the modulated signal is amplified and applied to an antenna 10.

It is observed that it is possible to apply hierarchical modulation to transmit the sequence of symbols corresponding to the codebook entries. The symbol which, when transmitted erroneously, gives the least perceptual effect is modulated on a sub-constellation which is superimposed on a main constellation. The remaining symbols of the sequence of symbols are modulated on the main constellation.

The sub-constellation has a smaller distance between its points than the distance between the points of the main constellation. Consequently, the symbols transmitted on the gain constellation are less prone to errors than symbols modulated on the sub-constellation.

In a situation where hierarchical modulation is used it is conceivable that the channel encoder can be dispensed with.

The signal transmitted by the antenna 10 is received by the antenna 12 and is passed to the receiver 14. In the receiver 14 the antenna signal is demodulated in a demodulator 16. The demodulator 16 passes the demodulated signal to a channel decoder 18. The channel decoder 18 decodes the received signals and corrects errors in them if possible. It is observed that it is possible that some symbols in the received signal are not encoded at all, and consequently they are passed to the output of the channel decoder unchanged. In the case that hierarchical modulation is used, it is also conceivable that the channel encoder 18 can be dispensed with. In the source decoder 20 the input signal of the transmitter 2 is reconstructed.

Figure 2:
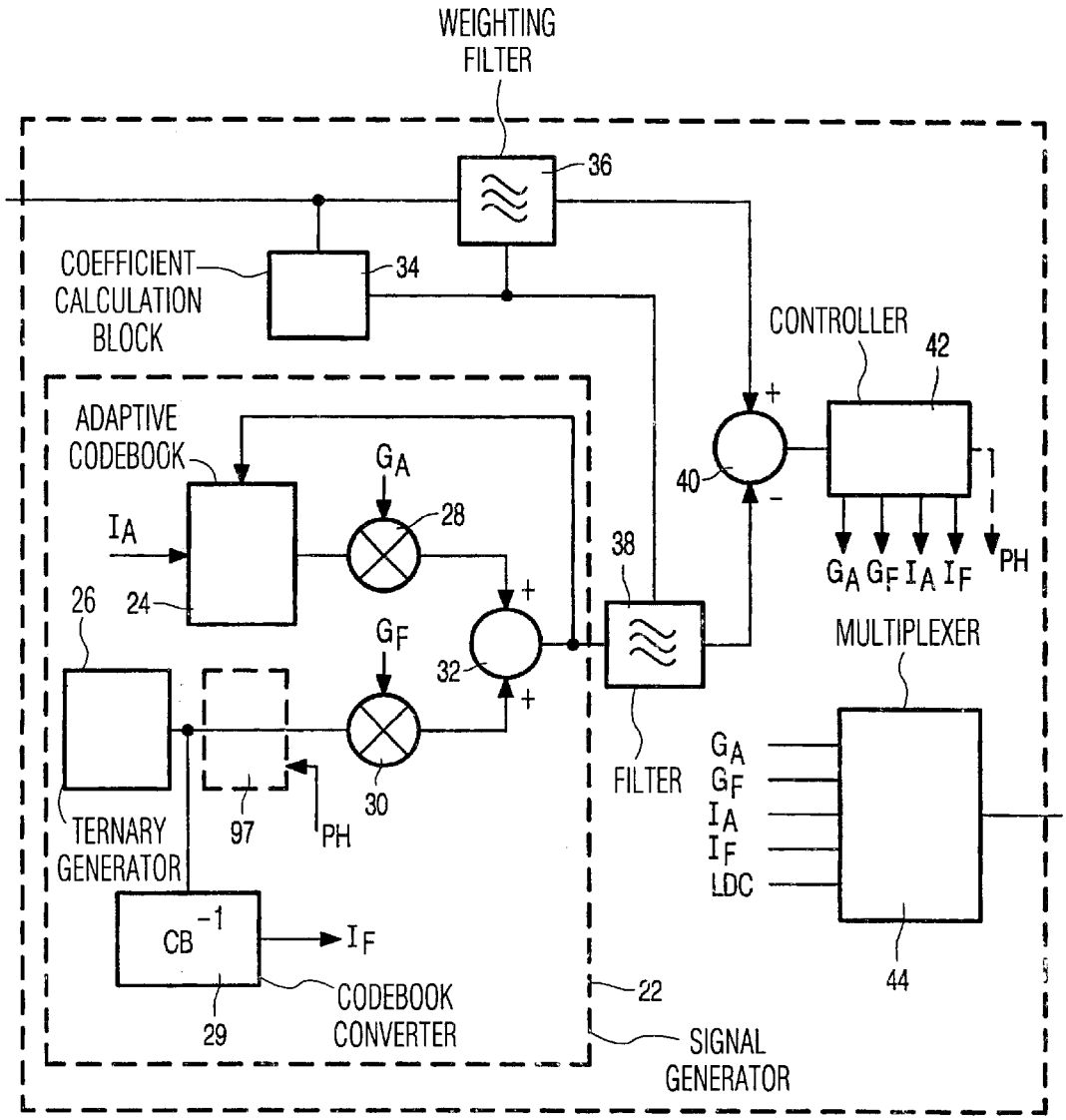
FIG. 2 shows a speech encoder according to the invention.

In the source encoder 4 according to FIG. 2 the signal to be encoded is applied to an input of an LPC coefficient calculation block 34 and to an input of a perceptual weighting filter 36. The output of the perceptual weighting filter 36 is connected to a first input of a subtractor 40.

An excitation signal generator 22 comprises a fixed codebook which is implemented as a ternary generator 26 and an adaptive codebook 24 in which the most recently used excitation signals are stored. The output signal of the ternary generator 26 represents a plurality of ternary samples, in which each digit of the ternary number represents a ternary sample value.

The output of the ternary generator 26 is connected to an input of a code converter 29 which is arranged for converting the ternary value at the output of the ternary generator 26 into a sequence of (binary) symbols for transmission. The output of the ternary generator 26 is also connected to a first input of a multiplier 30, optionally via a zero inserter 27. A signal $G_P$ is applied to a second input of the multiplier 30. The output of the multiplier 30 is connected to a first input of an adder 32.

The output of the adaptive codebook 24 is connected to a first input of a multiplier 28 and a signal $G_A$ is applied to a second input of the multiplier 28. The output of the multiplier 28 is connected to a second input signal of the adder 32. The output of the adder 32 which constitutes also the output of the excitation signal generator 22 is applied to a perceptually weighted synthesis filter 38 which received its filter coefficients from the LPC coefficient calculating block 34. An output of the perceptually weighted synthesis filter 38 is connected to a second input of the subtractor 40.

The output of the subtractor 40 is connected to an input of a controller 42. The controller 42 is arranged for finding an excitation signal resulting in a best match between the perceptually weighted speech signal available at the output of the perceptual weighting filter 36 and the perceptually weighted synthetic speech signal which is available at the output of the perceptually weighted synthesis filter 38. The controller 42 first determines the codebook index $I_A$ and the codebook gain $G_A$ for the adaptive codebook. The adaptive codebook holds the excitation samples applied to the synthesis filter 38 from previous excitation intervals. Due to the periodicity of(voiced) speech signals, it is likely that the best sequence of excitation samples is similar to a sequence of excitation samples present in the adaptive codebook.

After the optimum parameters $I_A$ and $G_A$ have been found, the controller means 42 continues with searching the optimum excitation parameters of the fixed codebook. The excitation parameters of the fused codebook are the fixed codebook index $I_F$ and the fixed codebook gain $G_F$. It is also possible that the excitation signal derived form the fixed codebook is constituted by a grid of excitation pulses having a plurality of excitation signal samples separated by a predetermined amount of zeros. In such a case also the position PH of the excitation samples in the grid has to be determined.

The search for the excitation parameters $I_F$ and $G_F$ is performed for each of the possible values of the position PH. The possible sequences of excitation samples are found by using the ternary generator 26 generating said ternary sequence of samples. For each sequence of (ternary) samples the optimum gain is determined. This gain can be determined by trying all possible gain values and selecting the value $G_F$ which results in a minimum error between the perceptually weighted speech signal and the perceptually weighted synthetic speech signal. It is also possible to determine the gain factor $G_F$ by first determining an auxiliary signal by subtracting from the perceptually weighted speech signal the contribution of the adaptive codebook to the perceptually weighted synthetic speech signal. The square of the gain factor $G_F$ can be found by dividing the cross correlation coefficient of the auxiliary signal and a perceptually weighted synthetic speech signal which is subjected to a gain of 1, by the power of said perceptually weighted synthetic speech signal.

These ways of determining the gain factor $G_F$ are well described in the prior art and are as such known to those skilled in the art.

In the table below a first example of a fixed codebook is given. In the table the binary sequence of symbols and the corresponding plurality of sample values is given. G(i) represents the sample value as a ternary number and E(i) represents the sample values as they are applied to the synthesis filter. In the codebook according to Table 1, the number of in one codebook entry equals to 3.

TABLE 1

| B(i) | G(i) | E(i) |
|---|---|---|
| 00000 | 000 | −1, −1, −1 |
| 00001 | 001 | −1, −1, 0 |
| 00010 | 002 | −1, −1, +1 |
| 00011 | 012 | −1, 0, +1 |
| 00100 | 011 | −1, 0, 0 |
| 00101 | 010 | −1, 0, −1 |
| 00110 | 020 | −1, +1, −1 |
| 00111 | 021 | −1, +1, 0 |
| 01000 | 022 | −1, +1, +1 |
| 01001 | 122 | 0, +1, +1 |
| 01010 | 121 | 0, +1, 0 |
| 01011 | 120 | 0, +1, −1 |
| 01100 | 110 | 0, 0, −1 |
| 01101 | 111 | 0, 0, 0 |
| 01110 | 112 | 0, 0, +1 |
| 01111 | 102 | 0, −1, +1 |
| 10000 | 101 | 0, −1, 0 |
| 10001 | 100 | 0, −1, −1 |
| 10010 | 200 | +1, −1, −1 |
| 10011 | 201 | +1, −1, 0 |
| 10100 | 202 | +1, −1, +1 |
| 10101 | 212 | +1, 0, +1 |
| 10110 | 211 | +1, 0, 0 |
| 10111 | 210 | +1, 0, −1 |
| 11000 | 220 | +1, +1, −1 |
| 11001 | 221 | +1, +1, 0 |
| 11010 | 222 | +1, +1, +1 |

In the case four phases PH are possible, the excitation signal can be presented by Table 2 as presented below

TABLE 2

| PH | EXCITATION SIGNAL |
|---|---|
| 0 | T, 0, 0, 0, T, 0, 0, 0, T, 0, 0, 0 |
| 1 | 0, T, 0, 0, 0, T, 0, 0, 0, T, 0, 0 |
| 2 | 0, 0, T, 0, 0, 0, T, 0, 0, 0, T, 0 |
| 3 | 0, 0, 0, T, 0, 0, 0, T, 0, 0, 0, T |

In Table 2 the letter T represents a ternary value (−1, 0,+1) according to Table 1. As stated before, the excitation signals are subsequently generated by a ternary generator. If the mean square error for a particular codebook entry generated by the ternary generator is lower than the mean square error tried before this codebook entry, the ternary count value is temporarily stored in a buffer memory. When all codebook entries have been tried, the buffer memory holds the best ternary count value.

From this count value the codebook converter 29 derives the binary representation to be used for transmission. It is observed that the most right bit of the binary representation according to Table 1 is the least vulnerable, because an error in it causes the ternary value to change only by +1 or −1 at one position.

The codebook according to Table 1 has the property according to an aspect of the invention that the binary representation of a first codebook entry $G(i_1)$ is equal to a binary sequence of symbols $B(i_2)$ representing a second codebook entry G(i2), and that the binary representation of said second codebook entry $G(i_2)$ is equal to the binary sequence of symbols $B(i_1)$ associated with the first codebook entry $G(i_1)$: This property can be utilized for enabling the use of the same table (or algorithm) for encoding and decoding the codebook entry.

If e.g. the ternary value $G(i_1)=122$ in Table 1 is the best codebook entry, the decimal value associated to it is $1\cdot3^2+2\cdot3^1+2\cdot3^0=17$ (decimal). The binary representation of 17 (decimal) is 10001. Using this binary value $B(i_2)$ to address Table 1, a corresponding ternary value $G(i_2)$ of 100 is found. The binary value corresponding to 100 (ternary) is 01001, being equal to the binary value $B(i_1)$ corresponding to the codebook entry with ternary value 122.

The codebook converter uses the above mentioned property to determine the sequence of symbols to be transmitted. It only needs the function B(i)→G(i), a function which is also needed in the decoder. Consequently this function can be shared between an encoder and a decoder in a full duplex terminal comprising a transmitter and a receiver.

TABLE 3

| B(i) | G(i) |
|---|---|
| 00000000 | 00000 |
| 00000001 | 00001 |
| 00000010 | 00002 |
| 00000011 | 00012 |
| 00000100 | 00011 |
| 00000101 | 00010 |
| 00000110 | 00020 |
| 00000111 | 00021 |
| 00001000 | 00022 |
| 00001001 | 00122 |
| 00001010 | 00121 |
| 00001011 | 00120 |
| 00001100 | 00110 |
| 00001101 | 00111 |
| 00001110 | 00112 |
| 00001111 | 00102 |
| 00010000 | 00101 |
| 00010001 | 00100 |
| 00010010 | 00200 |
| 00010011 | 00201 |
| 00010100 | 00202 |
| 00010101 | 00212 |
| 00010110 | 00211 |
| 00010111 | 00210 |
| 00011000 | 00220 |
| 00011001 | 00221 |
| 00011010 | 00222 |
| 00011011 | 01222 |
| 00011100 | 01221 |
| 00011101 | 01220 |
| 00011110 | 01210 |
| 00011111 | 01211 |
| 00100000 | 01212 |
| 00100001 | 01202 |
| 00100010 | 01201 |
| 00100011 | 01200 |
| 00100100 | 01100 |
| 00100101 | 01101 |
| 00100110 | 01102 |
| 00100111 | 01112 |
| 00101000 | 01111 |
| 00101001 | 01110 |

TABLE 3-continued

| B(i) | G(i) |
|---|---|
| 00101010 | 01120 |
| 00101011 | 01121 |
| 00101100 | 01122 |
| 00101101 | 01022 |
| 00101110 | 01021 |
| 00101111 | 01020 |
| 00110000 | 01010 |
| 00110001 | 01011 |
| 00110010 | 01012 |
| 00110011 | 01002 |
| 00110100 | 01001 |
| 00110101 | 01000 |
| 00110110 | 02000 |
| 00110111 | 02001 |
| 00111000 | 02002 |
| 00111001 | 02012 |
| 00111010 | 02011 |
| 00111011 | 02010 |
| 00111100 | 02020 |
| 00111101 | 02021 |
| 00111110 | 02022 |
| 00111111 | 02122 |
| 01000000 | 02121 |
| 01000001 | 02120 |
| 01000010 | 02110 |
| 01000011 | 02111 |
| 01000100 | 02112 |
| 01000101 | 02102 |
| 01000110 | 02101 |
| 01000111 | 02100 |
| 01001000 | 02200 |
| 01001001 | 02201 |
| 01001010 | 02202 |
| 01001011 | 02212 |
| 01001100 | 02211 |
| 01001101 | 02210 |
| 01001110 | 02220 |
| 01001111 | 02221 |
| 01010000 | 02222 |
| 01010001 | 12222 |
| 01010010 | 12221 |
| 01010011 | 12220 |
| 01010100 | 12210 |
| 01010101 | 12211 |
| 01010110 | 12212 |
| 01010111 | 12202 |
| 01011000 | 12201 |
| 01011001 | 12200 |
| 01011010 | 12100 |
| 01011011 | 12101 |
| 01011100 | 12102 |
| 01011101 | 12112 |
| 01011110 | 12111 |
| 01011111 | 12110 |
| 01100000 | 12120 |
| 01100001 | 12121 |
| 01100010 | 12122 |
| 01100011 | 12022 |
| 01100100 | 12021 |
| 01100101 | 12020 |
| 01100110 | 12010 |
| 01100111 | 12011 |
| 01101000 | 12012 |
| 01101001 | 12002 |
| 01101010 | 12001 |
| 01101011 | 12000 |
| 01101100 | 11000 |
| 01101101 | 11001 |
| 01101110 | 11002 |
| 01101111 | 11012 |
| 01110000 | 11011 |
| 01110001 | 11010 |
| 01110010 | 11020 |
| 01110011 | 11021 |
| 01110100 | 11022 |
| 01110101 | 11122 |
| 01110110 | 11121 |

TABLE 3-continued

| B(i) | G(i) |
|---|---|
| 01110111 | 11120 |
| 01111000 | 11110 |
| 01111001 | 11111 |
| 01111010 | 11112 |
| 01111011 | 11102 |
| 01111100 | 11101 |
| 01111101 | 11100 |
| 01111110 | 11200 |
| 01111111 | 11201 |
| 10000000 | 11202 |
| 10000001 | 11212 |
| 10000010 | 11211 |
| 10000011 | 11210 |
| 10000100 | 11220 |
| 10000101 | 11221 |
| 10000110 | 11222 |
| 10000111 | 10222 |
| 10001000 | 10221 |
| 10001001 | 10220 |
| 10001010 | 10210 |
| 10001011 | 10211 |
| 10001100 | 10212 |
| 10001101 | 10202 |
| 10001110 | 10201 |
| 10001111 | 10200 |
| 10010000 | 10100 |
| 10010001 | 10101 |
| 10010010 | 10102 |
| 10010011 | 10112 |
| 10010100 | 10111 |
| 10010101 | 10110 |
| 10010110 | 10120 |
| 10010111 | 10121 |
| 10011000 | 10122 |
| 10011001 | 10022 |
| 10011010 | 10021 |
| 10011011 | 10020 |
| 10011100 | 10010 |
| 10011101 | 10011 |
| 10011110 | 10012 |
| 10011111 | 10002 |
| 10100000 | 10001 |
| 10100001 | 10000 |
| 10100010 | 20000 |
| 10100011 | 20001 |
| 10100100 | 20002 |
| 10100101 | 20012 |
| 10100110 | 20011 |
| 10100111 | 20010 |
| 10101000 | 20020 |
| 10101001 | 20021 |
| 10101010 | 20022 |
| 10101011 | 20122 |
| 10101100 | 20121 |
| 10101101 | 20120 |
| 10101110 | 20110 |
| 10101111 | 20111 |
| 10110000 | 20112 |
| 10110001 | 20102 |
| 10110010 | 20101 |
| 10110011 | 20100 |
| 10110100 | 20200 |
| 10110101 | 20201 |
| 10110110 | 20202 |
| 10110111 | 20212 |
| 10111000 | 20211 |
| 10111001 | 20210 |
| 10111010 | 20220 |
| 10111011 | 20221 |
| 10111100 | 20222 |
| 10111101 | 21222 |
| 10111110 | 21221 |
| 10111111 | 21220 |
| 11000000 | 21210 |
| 11000001 | 21211 |
| 11000010 | 21212 |
| 11000011 | 21202 |

TABLE 3-continued

| B(i) | G(i) |
|---|---|
| 11000100 | 21201 |
| 11000101 | 21200 |
| 11000110 | 21100 |
| 11000111 | 21101 |
| 11001000 | 21102 |
| 11001001 | 21112 |
| 11001010 | 21111 |
| 11001011 | 21110 |
| 11001100 | 21120 |
| 11001101 | 21121 |
| 11001110 | 21122 |
| 11001111 | 21022 |
| 11010000 | 21021 |
| 11010001 | 21020 |
| 11010010 | 21010 |
| 11010011 | 21011 |
| 11010100 | 21012 |
| 11010101 | 21002 |
| 11010110 | 21001 |
| 11010111 | 21000 |
| 11011000 | 22000 |
| 11011001 | 22001 |
| 11011010 | 22002 |
| 11011011 | 22012 |
| 11011100 | 22011 |
| 11011101 | 22010 |
| 11011110 | 22020 |
| 11011111 | 22021 |
| 11100000 | 22022 |
| 11100001 | 22122 |
| 11100010 | 22121 |
| 11100011 | 22120 |
| 11100100 | 22110 |
| 11100101 | 22111 |
| 11100110 | 22112 |
| 11100111 | 22102 |
| 11101000 | 22101 |
| 11101001 | 22100 |
| 11101010 | 22200 |
| 11101011 | 22201 |
| 11101100 | 22202 |
| 11101101 | 22212 |
| 11101110 | 22211 |
| 11101111 | 22210 |
| 11110000 | 22220 |
| 11110001 | 22221 |
| 11110010 | 22222 |

Table 3 comprises 243 codebook entries which are addressed by 8 bits indices. properties with respect to inverse mapping as the codebook according to Table 1.

It is observed that fixed codebook sequences can be obtained by concatenating the sequences according to Table 1 and Table 3 once or more than once. In this way codebook entries having an arbitrary number of samples, except 1,2,4 and 7 samples, can be realized. This is in particular advantageous for multirate coders. The representation of these codebook entries is simple formed by the concatenation of the correponding 5 bit and 8 bit indices.

The excitation parameters $I_A$, $G_A$, $I_F$ represented by B(i) and $G_F$ are multiplexed by a multipexer 44. At the output of the multiplexer 44 the multiplexed signal is available for further encoding by the channel encoder 6 is FIG. 1.

Figure 3:
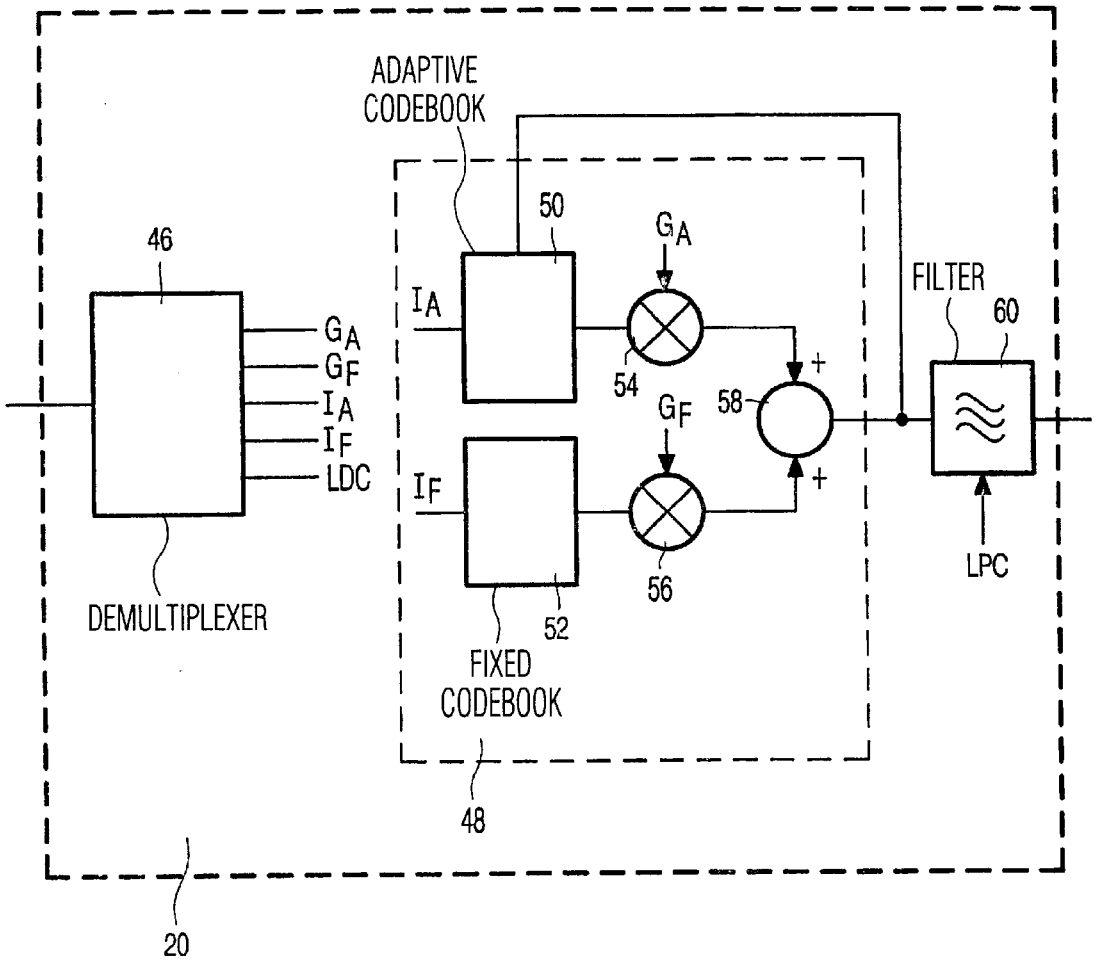
FIG. 3 shows a speech decoder according to the invention.

In the source decoder 20, according to FIG. 3, the signal received from the channel decoder 18 (FIG. 1) is applied to a demultiplexer 46. The demultiplexer 46 extracts the prediction parameters LPC and the excitation parameters $G_A$, $G_F$, $I_A$ and $I_F$, the latter being represnted by the sequence of symbols B(i).

The adaptive codebook index $I_A$ is applied to an input of an adaptive codebook of the adaptive codebook 50 is applied to a first input of a multiplier 54. The adaptive codebook gain $G_A$ is applied to a second input of the multiplier 54. The output of the multiplier 54 is connected to a first input of an adder 58.

The fixed codebook index $I_F$, represented by the sequence of symbols B(i), is applied to an input of a fixed codebook 52 having codebook entries according to the present invention. The output of the codebook 52 is connected to a first input of a multiplier 56. The fixed codebook gain $G_P$ is applied to a second input of the multiplier 56. The output of the multiplier 56 is connected to a second input of the adder 58. At the output of the adder 58 the excitation signal for a synthesis filter 60 is available. The excitation signal is also applied to an input of the adaptive codebook in which the most recent excitation samples are written and from which the least recent excitation samples are removed.

The synthesis filter 60 derives a synthetic speech signal from the excitation signal available at the output of the adder 58. To doso the synthesis filter 60 receives the LPC parameters LPC from the demultiplexer 46.

Figure 4:
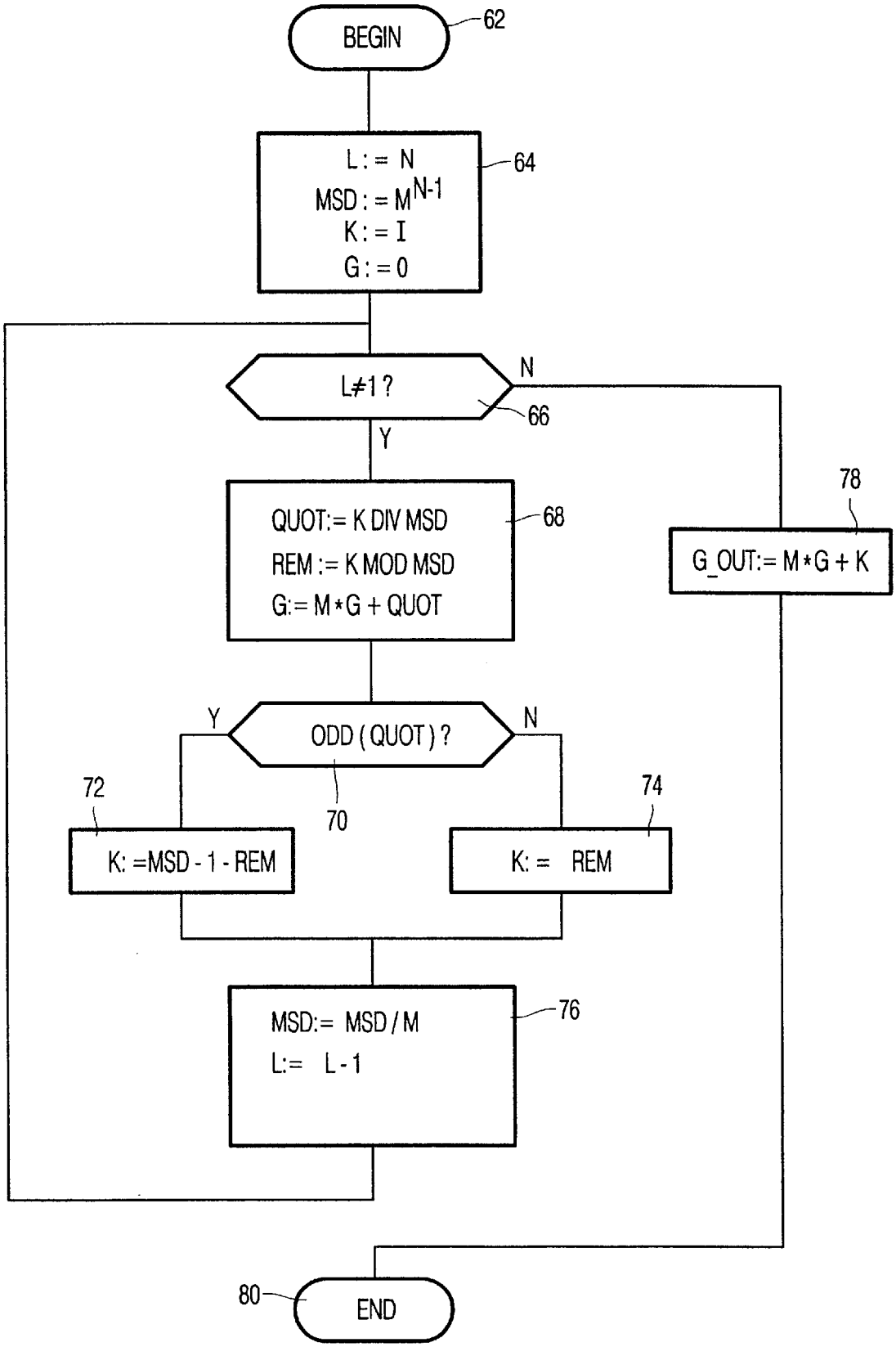
FIG. 4 shows a flow graph of a program for a programmable processor for converting a sequence of symbols indicating the codebook index into the corresponding plurality of samples.

In the flow graph according to FIG. 4 the numbered instructions have the following meaning:

| Nr. | inscription | meaning |
|---|---|---|
| 62 | BEGIN | The program is started. |
| 64 | L:=N; MSD:=$M^{N-1}$; K:=I; G:=0 | The running variable L is set to the number of excitation samples N. The value of the Most Significant Digit (MSD) under consideration is set to $M^{N-1}$. The variable K is set to the index I. The intermediate result G is set to 0 |
| 66 | L ≠ 1 ? | It is checked whether L differs from 1. |
| 68 | QUOT := K DIV MSD; REM := K MOD MSD; G := M*G + QUOT | The variables QUOT and REM are calculated from K and MSD. The intermediate result G is recalculated. |
| 70 | ODD( QUOT ) ? | It is checked whether the variable QUOT is odd. |
| 72 | K := MSD − 1 − REM | The new value of the variable K is calculated for K is odd. |
| 74 | K := REM | The new value of the variable K is calculated for K is even. |
| 76 | MSD:=MSD/QUOT L := L − 1 | The new values of L, G and MSD are calculated. |
| 78 | G_OUT=QUOT*G+K | The final value G_OUT of the codebook entry is calculated. |
| 80 | END | The program is terminated. |

The program according to the flow graph of FIG. 4 is arranged for calculating the pluralitof excitation samples for a given value of the index i. It is observed that the binary representation of i is transmitted. The plurality of excitation samples is represented by an M-ary number G(i,N) of which the digits represent the excitation samples. N is the number of samples and consequently the number of digits in the M-ary number.

The calculation of G(i,N) is based on a recursive definition of G(i,N). If each codebook entry comprises N samples, the codebook can be represented as a set of $L=M^N$ vectors sequences of samples $X_0$, $X_1$, $X_2$, . . . ,$X_{L-2}$, $X_{L-1}$. The codebook can be extended by one sample value to N+1 samples, by adding digits to the different vectors according to:

$\mathbf{0}x_0, \ldots, \mathbf{0}x_{L-2}, \mathbf{0}x_{L-1}, \mathbf{1}X_{L-1}, \mathbf{1}X_{L-2}, \ldots \mathbf{1}x_1, \mathbf{1}x_0, \mathbf{2}x_0, \mathbf{2}x_1, \ldots, \mathbf{2}x_{L-2}, \mathbf{2}x_{L-1}$ (in case of a ternary codebook). For N is equal to 1, the function G(i, N) is equal to i. For i larger than N, i is decomposed into the sum of a quotient q of i and the value $M^{N-1}$ of the $N^{th}$ digit of G, and a remainder r. This decomposition is performed for all values of N for which i is smaller or equal to $M^n-1$. From q the value G(i,N) is calculated according to:

$$G(i,N)=\begin{cases} q\cdot M^{N-1}+G(i-q\cdot M^{N-1},n-1); & q \text{ is even} \\ q\cdot M^{N-1}+G((q+1)\cdot M^{N-1}-i-1,n-1); & q \text{ is odd} \end{cases} \quad (A)$$

The program according to FIG. 4 determines the value of G(i,N) in a recursive way from i. The program starts at instruction 62. In instruction 64 an variable L is set to N. The value of the most significant digit MSD is made equal to $M^{N-1}$. The value of variable K is set to the value of the index i of the function G(i,N) to be calculated. The variable G is set to 0.

In instruction 66 it is checked whether L is unequal to 1. If L is unequal to 1 the calculations are continued with instruction 68. In instruction 68 first the quotient QUOT of K and MSD is determined. This corresponds to the determination of the most significant digit of K. Subsequently the remainder REM of the division of K by MSD is determined. This corresponds to the determination of the value represented by the remaining digits of K. Finally an intermediate value of G is determined by multiplying the previous value of G by M and adding the value of QUOT to G.

In instruction 70 it is checked whether the quotient QUOD is even or odd. In the case QUOD is even, the value of K is made equal to the remainder REM in instructor 74. In the case QUOD is odd, the value of K is made equal to MSD-1-REM in instructor. This different way K is calculated for even and odd values of QUOD is caused by the ordering of the values of G as function of the index i. From Table 1 it can be seen that the value of the most significant digit of G but one increases as function of i for even values of the most significant digit of G. The value of the most significant digit of G but one decreases as function of i for odd values of the most significant digit of G.

In instruction 76 first the value of MSD is divided by M in order to prepare for the repetition of the previous calculations for the most significant digit of I but one. Subsequently the value of L is decremented and the program is continued at instruction 66. In this way all digits of I are converted to the codebook entry represented by G. If L is equal to 1, the process of converting is finalized, and in instruction 78 the final value of G is calculated by multiplying the value of G found by the previous calculations by M and adding the value of K. In instruction 80 the program is terminated.

Before the codebook entry calculated according to the above program is applied to a synthesis filter it has to be converted into an M-ary representation. As mentioned before, the algorithm according to the program shown in FIG. 4 can also be used to find the index i from a given codebook entry. In order to do so, the program has first to be called with the codebook entry as input. Subsequently the program has to be called again but now with using the result of the first call of the program as input. The index i is now found by converting the result of the second call of the program into a binary number.

What is claimed is:

1. A transmission system comprising:

a transmitter with a signal encoder, the signal encoder having an input for a signal to be encoded and a codebook entry selector for selecting a codebook entry for producing a synthetic signal giving a best approximation of a signal representative of the input signal, wherein the codebook entry is associated with a plurality of samples that can assume more than two values and is identified with a sequence of symbols, a receiver having a decoder with a codebook for deriving the codebook entry from the sequence of symbols received from the transmitter;

wherein the codebook entries corresponding to sequences of symbols that differ in one particular symbol value are associated with sample values that differ in one single sample value.

2. The system according to claim 1, wherein the difference between said sample values of codebook entries corresponding to sequences of symbols differing in one particular symbol value is equal to a smallest quantization step of said sample value.

3. The system according to claim 1, wherein the number of possible sample values is odd.

4. The system according to claim 1, wherein a numerical value associated with a first codebook entry is equal to the numerical value of the sequence of symbols of a second codebook entry, and in that the numerical value associated with the second codebook entry is equal to the numerical value of the sequence of symbols associated with the first codebook entry.

5. A transmitter comprising:

a signal encoder having an input for a signal to be encoded, said signal encoder having a codebook entry selector for selecting a codebook entry and for producing a synthetic signal giving a best approximation of a signal representative of the input signal, the codebook entry having a plurality of samples that can assume more than two values, said codebook entry being identified with a sequence of symbols, wherein the codebook entries corresponding to sequences of symbols that differ in one particular symbol value are associated with sample values that differ in one single sample value.

6. A receiver comprising:

means for receiving an encoded signal having a sequence of symbols representative of a codebook entry comprising a plurality of samples that can assume more than two values, a decoder with a codebook for deriving the codebook entry from the received sequence of symbols; wherein the codebook entries corresponding to sequences of symbols that differ in one particular symbol value are associated with sample values that differ in one single sample value.

7. A source encoder for use in a transmission system, wherein the transmission system includes a transmitter and a receiver and wherein the source encoder is located in the transmitter, the source encoder comprising:

a signal generator, the signal generator comprising:

a ternary generator for outputting a ternary number representative of sample values;

a codebook;

a code converter, connected to the output of the ternary generator, for converting the ternary number into a sequence of binary symbols, and means for selecting an entry from the codebook and for producing a synthetic signal giving a best approximation of a signal representative of the input signal;

wherein each codebook entry (a) is associated with a plurality of samples that can assume more than two values and (b) can be identified with a sequence of symbols, such that each codebook entry corresponding to sequences of symbols that differ in one particular symbol value are associated with sample values that differ in one single sample value.

* * * * *